United States Patent [19]

Bangs et al.

[11] Patent Number: 4,708,500

[45] Date of Patent: Nov. 24, 1987

[54] THERMAL PRINTER

[75] Inventors: Richard G. Bangs; Michael O. Grey, both of Ithaca, N.Y.

[73] Assignee: NCR Corporation, Dayton, Ohio

[21] Appl. No.: 818,413

[22] Filed: Jan. 13, 1986

[51] Int. Cl.[4] ..... B41J 3/20; B41J 25/28

[52] U.S. Cl. ..... 400/120; 400/320

[58] Field of Search ..... 400/120, 320, 328, 322, 400/55, 56, 57, 58, 59

[56] References Cited

U.S. PATENT DOCUMENTS

| | | | |
|---|---|---|---|
| 3,509,980 | 5/1970 | Loughry et al. | 197/1 |
| 3,777,116 | 12/1973 | Brescia et al. | 219/216 |
| 3,989,131 | 11/1976 | Knirsch et al. | 400/120 |
| 4,000,393 | 12/1976 | Cochran et al. | 219/216 |
| 4,173,273 | 11/1979 | Hanakata | 400/120 |
| 4,194,847 | 3/1980 | Grey | 400/320 |
| 4,259,026 | 3/1981 | Hanaoka et al. | 400/320 X |

FOREIGN PATENT DOCUMENTS

| | | | |
|---|---|---|---|
| 3511316 | 10/1985 | Fed. Rep. of Germany | 400/320 |
| 54588 | 3/1984 | Japan | 400/328 |
| 184685 | 10/1984 | Japan | 400/120 |
| 2140746 | 12/1984 | United Kingdom | 400/120 |

*Primary Examiner*—Charles A. Pearson

*Attorney, Agent, or Firm*—Wilbert Hawk, Jr.; Albert L. Sessler, Jr.; George J. Muckenthaler

[57] ABSTRACT

A thermal printer has carriage means supporting a print head for travel along a platen and has camming means operably associated with the carriage means for providing a predetermined pressure of the print head against the platen in one direction of travel of the print head and for releasing or reducing such pressure in the other direction of travel.

6 Claims, 10 Drawing Figures

THERMAL PRINTER

BACKGROUND OF THE INVENTION

In the area of thermal printers, it is wellknown that the use of such printers is increasing for certain operations that require a reduction in noise levels and at a reasonable cost. While development work is continually progressing to increase the speed of operation with minimum maintenance or care of the equipment, it is seen that improvements are being made to provide a higher quality print with a reduced number of thermal elements.

In the case of thermal printers, it is necessary to minimize the complexity of the thermal print head and the associated electronic controls. In certain prior art printers, it has been common practice to provide a thermal print head having a plurality of thermal printing elements on the surface of the head and wherein selected elements are energized to provide printing on thermal paper or like record media with the print head operating in a stationary or fixed position relative to the printer frame. The thermal printing elements on the print head may take the form of pads or contact surfaces in the shape of characters and connected by conducting runs to side or edge connectors. A flexible flat ribbon-like cable is normally used to connect with the pads or contact surfaces on the print head and the individual leads or wires of the cable may include end connectors or terminals for contact with the print head pads.

More recently, development work in thermal printers has included a shuttling-type print head having approximately 20% of the number of print elements as compared to the number of elements on a fixed or stationary head.

One of the problems encountered with the shuttling print head is that of smudging the thermal paper on which the printed image is formed by reason of pressure or contact between the print head and the paper or between the print head and the platen during travel of the print head across the printer. Since it is common practice to print in one direction of travel of the print head, it is deemed to be an improvement over prior printing apparatus and is advantageous to eliminate or at least reduce the pressure of the print head against the thermal paper and against the platen during the return cycle of the print head and its carriage.

Representative prior art in the field of thermal print heads includes U.S. Pat. No. 3,509,980, issued to C. R. Loughry et al. on Mar. 12, 1968, which discloses a thermal printer having a print head slidably mounted on a guide bar member which pivots to force the print head into engagement with a thermally-sensitive print medium and such force is controlled by a spring.

U.S. Pat. No. 3,777,116, issued to R. Brescia on Dec. 4, 1973, discloses a thermographic print head which utilizes springs to hold the resistive elements in firm contact with a metal band.

U.S. Pat. No. 4,000,393, issued to M. J. Cochran et al. on Dec. 28, 1976, discloses a thermal print head assembly wherein the heating elements are typically held in contact with the thermally sensitive paper by a spring-loaded pivot arrangement.

U.S. Pat. No. 4,173,273, issued to T. Hanakata on Nov. 6, 1979, discloses a thermal printer device having an electromagnetic plunger to control printing and to urge the thermal head against the printing medium with a predetermined pressure force. A spring controls relative movement between the head and the medium with a lower pressure force.

SUMMARY OF THE INVENTION

The present invention relates to thermal printers. More particularly, the invention is directed to a print head carriage that travels back and forth across the printer and supports a thermal print head for printing on thermal paper which is directed in a path past a platen. In a preferred arrangement of the invention, the print head is caused to be moved across the printer in one direction of travel wherein the head is urged or biased against the thermal paper and the platen with a predetermined pressure and wherein printing is accomplished in such one direction. When the print head is moved in the opposite or return direction or the return cycle of operation, the carriage and the print head assembly are pivoted away from the thermal paper in a manner to reduce the pressure thereagainst.

In such preferred arrangement, the print head carriage is supported at a generally central location thereof from a crosswise shaft in pivotal manner and is supported at an extremity thereof on a plate cam which is rotatably driven by suitable drive means. The plate cam defines a groove of continuous irregular-shape and of varying depth for operation therein by a spring-loaded cam follower. When the plate cam is rotated, the follower causes transverse movement of the print head carriage in one direction wherein the follower is traveling in a print portion of the groove and the print head is pivoted on the shaft so as to have pressure exerted by the print head against the paper and the platen for printing operation. In this respect, the groove in the cam along the print portion thereof is shallow and thus provides that the print head is pivoted toward the platen with increased pressure.

When the plate cam continues to be rotated, the follower goes through a transition portion from the shallow groove to a deep groove, thereby allowing the carriage to pivot on the shaft and to decrease the pressure of the print head on the thermal paper. The follower continues to travel in the deep groove during the return portion of the print cycle and at the end of the travel again goes through a transition portion of the groove to the shallow part for the printing operation.

Modifications or variations in the inventive concept include a plate cam having a varying thickness for effecting pressure release in the return cycle portion of the groove and also a drum cam having a rail wherein the height thereof changes to provide pressure release during the carriage and print head return portion of the printing cycle of operation.

In view of the above discussion, the principal object of the present invention is to provide an improved print head arrangement for a thermal printer.

Another object of the present invention is to provide a pivotal print head carriage for a thermal printer.

An additional object of the present invention is to provide cam means for a thermal print head that releases pressure of the print head from the thermal paper.

A further object of the present invention is to provide a carriage for carrying the print head and including cam and follower means for effecting release of pressure of the print head during return travel thereof.

Still another object of the present invention is to provide cam means operably associated with a thermal print head and defining groove means for effecting increased and decreased pressure on the print head.

Additional objects and advantages of the present invention will become apparent and fully understood from a reading of the following specification taken together with the annexed drawing.

DESCRIPTION OF THE PREFERRED EMBODIMENT

Figure 1:
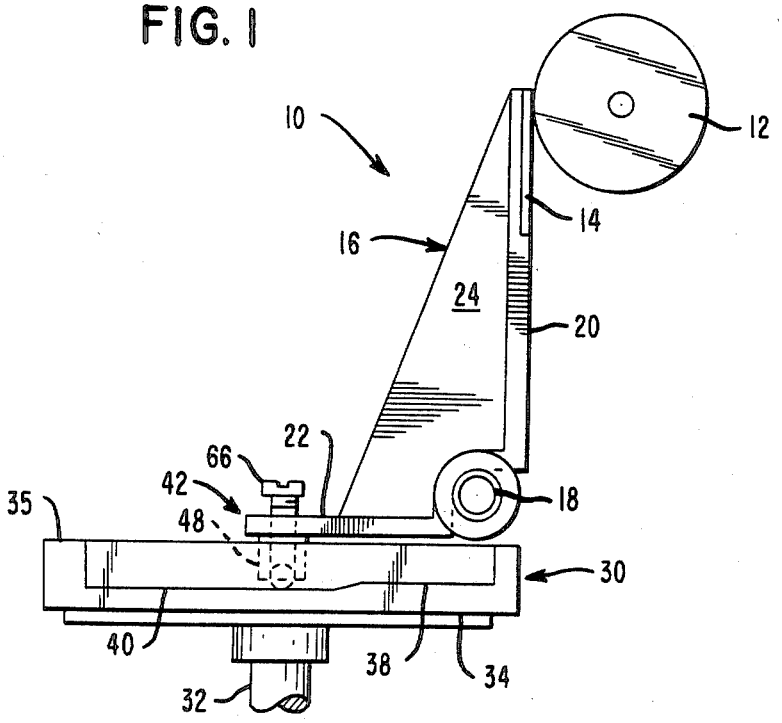
FIG. 1 is a side elevational view of a portion of a thermal printer incorporating the subject matter of the present invention in a preferred arrangement thereof.

Referring now to the drawing, FIG. 1 shows a portion of a thermal printer 10 that includes a round platen 12 suitably supported from the frame (not shown) of the printer. A thermal print head 14 of well-known design and structure is supported from and carried by a print head carriage 16 that is caused to be shuttled or moved in reciprocating manner by appropriate mechanism in the direction of viewing by the observer in FIG. 1. The carriage 16 is pivotally supported on a shaft 18 journalled in the frame of the printer and such carriage includes an upstanding plate portion 20 and a generally horizontal plate portion 22 with gusset means 24 bridging the two portions at appropriate locations.

Figure 2:
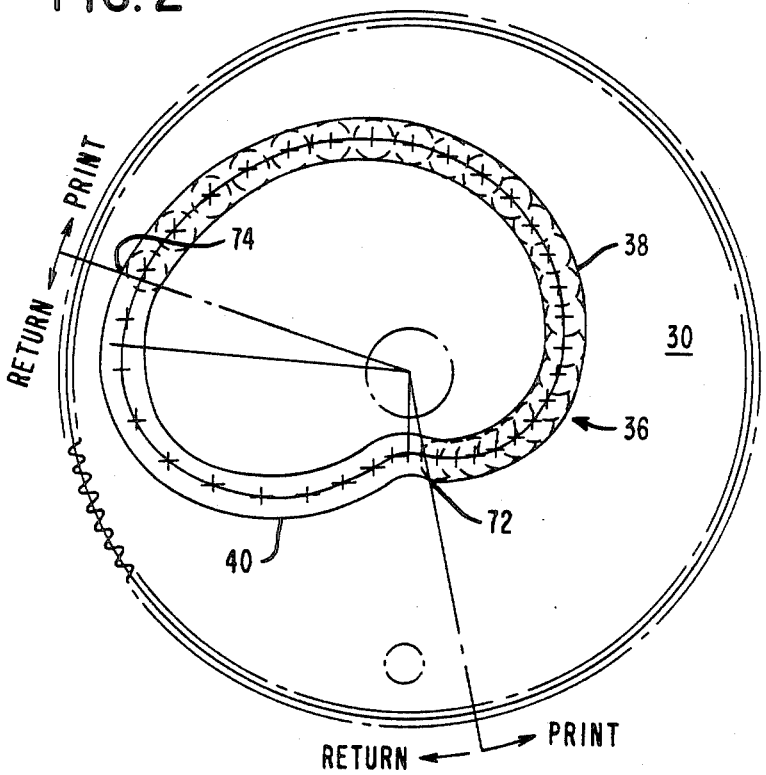
FIG. 2 is a plan view of the cam means and showing the various portions thereof in the print cycle of operation.

A plate-like cam 30 of circular configuration is positioned to be rotatably driven by means of a shaft 32 of a motor (not shown). The plate cam 30 includes a base portion 34 and a wall portion 35 along the circumference of the cam. An irregular-shaped groove 36 (shown in diagrammatic form in FIG. 2) is cut, as by machining, in the base portion 34 of the cam 30. The groove 36 is cut basically at two levels, an upper level, as at 38, and a lower level, as at 40, in FIG. 1. In FIG. 2, the two levels 38 and 40 of the groove 36 are identified by the portion with dotted circles which represents the printing portion of the print cycle whereas the portion of the groove absent the dotted circles represents the return portion of the print cycle.

Figure 3:
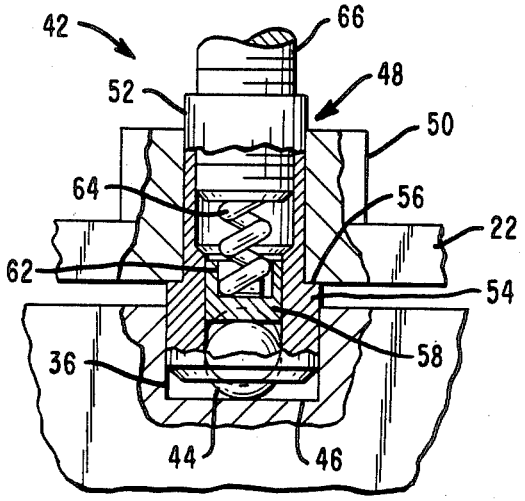
FIG. 3 is a sectional view showing the cam and follower means in a pressure-released mode.
Figure 4:
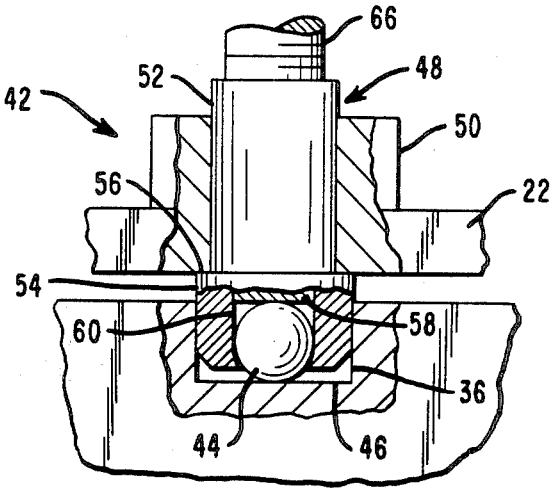
FIG. 4 is a sectional view showing the cam and follower means in a pressure mode for printing operation.

The horizontal plate portion 22 of the print head carriage 16 includes cam follower mechanism, generally designated as 42, such mechanism having a follower ball 44, see also FIGS. 3 and 4, which rides on the bottom surface 46 of the groove 36. The ball 44 is captured in a cylindrical member 48 contained and secured by a flange portion 50 of the horizontal plate portion 22 of the print head carriage 16. The cylindrical member 48 has an upper portion 52 and a lower follower portion 54, both in the form of sleeves and wherein the lower portion 54 includes a step 56 for seating the plate portion 22.

An insert 58 is provided in the hollow portion 60 of the lower portion 54 and in contact with the upper surface of the ball 44. The insert 58 is formed with a recess 62 for receiving one end of a coil spring 64, the other end being in contact with an adjusting screw 66 threaded into the upper portion 52 of the member 48. The adjusting screw 66 permits and regulates the amount of print head 14 to platen 12 pressure that is normally required for the printing operation and also provides for tolerance variations in the depth of the groove 36 in the cam plate 30, especially during the print portion of the total carriage movement cycle. The adjustment may also compensate for normal variations in the diameter of the material utilized in the platen 12.

It is thus seen that FIG. 3 illustrates the position of the ball 44 when the follower mechanism 42 is riding in the pressure released mode or return portion 40 of the groove 36, and FIG. 4 illustrates the position of the ball 44 when the follower mechanism is riding in the pressure mode or print portion 38 of the groove 36. The depth of the groove 36 is greater in FIG. 3 as compared to FIG. 4 and a dotted line position of the ball 44 in FIG. 3 illustrates the relative positions thereof during printing and return portions of the printing cycle.

In the operation of the printer 10 utilizing the subject matter of the present invention, the return portion of the printing cycle occurs when the print head 14 moves in one direction of travel, for example, from right to left in conventional manner, and the follower mechanism 42 is positioned so that the ball 44 is traveling along the groove 36 at the lower level 40, as seen in FIGS. 1 and 3 and for an extent of travel as seen in the return portion of FIG. 1. During this period of time the print head carriage 16 is rotated a slight amount at pivot shaft 18 and the print head 14 is released from contact with the platen 12 at a reduced pressure.

When the print head 14 moves in the other direction of travel, as from left to right for the print portion of the printing cycle, the follower mechanism is positioned so that the ball 44 is traveling along the groove 36 at the upper level 38, as is seen in FIGS. 1 and 4 and for an extent of travel as seen in the print portion of FIG. 2. It is here noted that the groove 36 includes ramp portions 72 and 74 (FIG. 2), the ramp portion 72 occupying a transition area when the cam follower ball 44 goes from the upper level 38 to the lower level 40 at the point in time when the printing cycle goes from the print portion to the return portion. The ramp portion 74 occupies a transition area wherein the cam follower ball 44 goes from the lower level to the upper level at the point in time when the printing cycle goes from the return portion to the print portion. In the lower level of operation, the contact pressure is reduced between the print head 14 and the platen 12 by reason of the print head carriage being pivoted a slight amount at the shaft 18. In the upper level of operation, the contact pressure is increased for normal printing operation.

Figure 5:
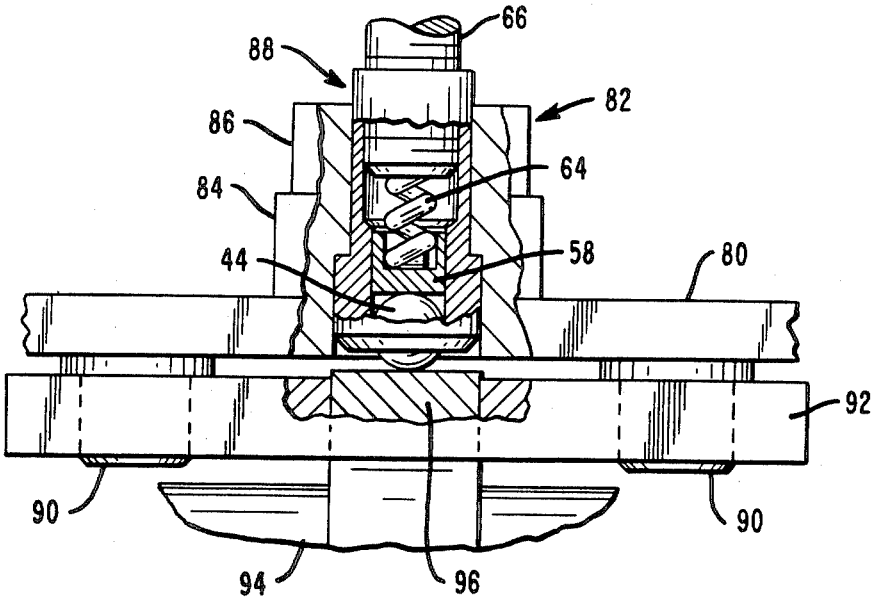
FIG. 5, on the sheet with FIG. 1, is a modification of the invention showing a rail cam arrangement.

FIG. 5 illustrates a modification of the pressure release mechanism of the present invention wherein a carriage 80 has an upright cylindricallyshaped arrangement 82 having a lower stepped portion 84 and an upper portion 86 of lesser diameter for containing a cam follower mechanism 88 that includes the ball 44, the insert 58, the spring 64 and the adjusting screw 66. The carriage 80 also includes a plurality of projections 90 fitted into and extending through a follower 92. A drum type cam 94 has a rail 96 as an integral part thereof for carrying and providing a surface for the ball 44 and for providing a pressure release arrangement during carriage return of the printing cycle.

Figure 6:
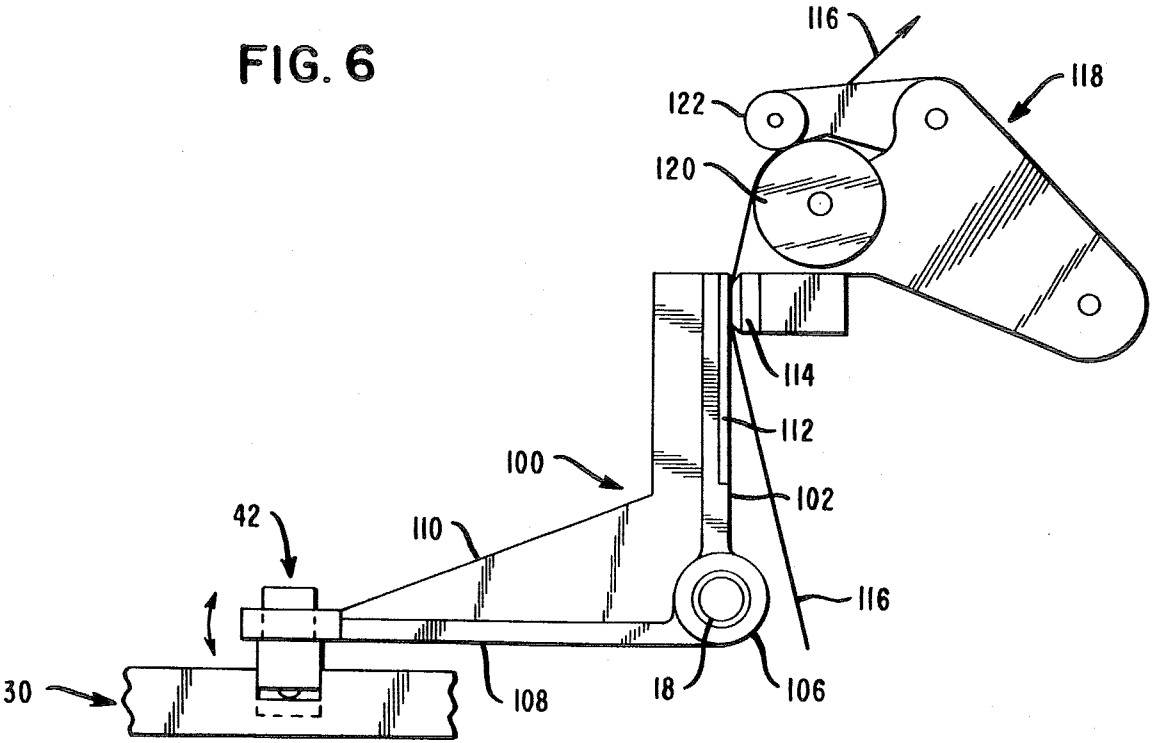
FIG. 6 is a view similar to FIG. 1 and showing additional mechanism.

FIG. 6 is a side elevational view illustrating certain similar mechanism as FIG. 1 but including additional structure. The thermal printer 10 includes a print head carriage 100 pivotally supported on the shaft 18 and including an upstanding plate portion 102 suitably coupled or connected with the journal or bearing 106 for the shaft 18. A generally horizontal plate portion 108 is also coupled or connected with the journal or bearing 106 and carries the cam follower mechanism 42. Gusset means 110 bridges the upstanding portion 102 and the horizontal portion 108 of the carriage 100. A print head 112 is supported from the carriage 100 and is adjacent a platen 114 of generally flat construction with paper or like record media 116 being driven or advanced in a path between the print head 112 and the platen 114. Paper feed mechanism 118 includes a paper drive roller 120 and a pressure roller 122 both suitably supported for advancing or transporting the paper by pulling thereof in a precise path past the printing station.

FIG. 6 illustrates the arrangement of the structure of the present invention in one application of the thermal transfer concept wherein it is necessary to index an ink ribbon (not shown) after each line of printing. In such application it is common to provide a ribbon cassette (not shown), horizontally disposed, so that the ribbon is trained in a path between the print head 112 and the platen 114. It is seen that in order to effect the indexing of the ribbon along the print line, it is necessary to release the platen pressure and also to actually separate the print head 112 from the platen 114 by a finite distance.

The pressure release mechanism of the present invention provides for accomplishing such separation of the print head 112 from the platen 114 primarily by reason that the shaft 18 is positioned substantially or directly below the print head. In this arrangement, it is seen that the weight of the cam follower mechanism 42 along with that of the print head carriage continuously urges the print head 112 from the platen 114. It is further seen that by reason of the location of the shaft 18 relative to the print head 112 the print head carriage 100 can be stopped during the pressure release portion of the cycle and while the printer is idle, and that any tendency to smudge the paper is eliminated. The shaft 18 is pivoted at the location directly under the print head 112 to provide for opening the platen gap during print head return and print idle modes.

In another application of the thermal transfer concept and utilizing the subject matter of the present invention and providing a different paper transport mechanism and arrangement from that shown in FIG. 6, the thermal transfer printer is equipped with transport mechanism to push the paper through or past the print station, rather than to pull the paper as is represented in such FIG. 6. In the paper push-type arrangement it is necessary that the print head 112 be separated from the platen 114 and that a platen gap be provided to enable pushing the paper between the print head and the platen without buckling the paper in its path past the print station. A paper supply (not shown) is usually provided at a location to the right of the shaft 18 in FIG. 6 and the paper is advanced in a path from a supply roll upwardly past suitable guides and drive rolls (not shown) and past the printing station. In this application of the thermal transfer concept, a ribbon cassette or horizontal ribbon mechanism may likewise be provided to enable an ink ribbon to be indexed after each line of printing.

Figure 7:
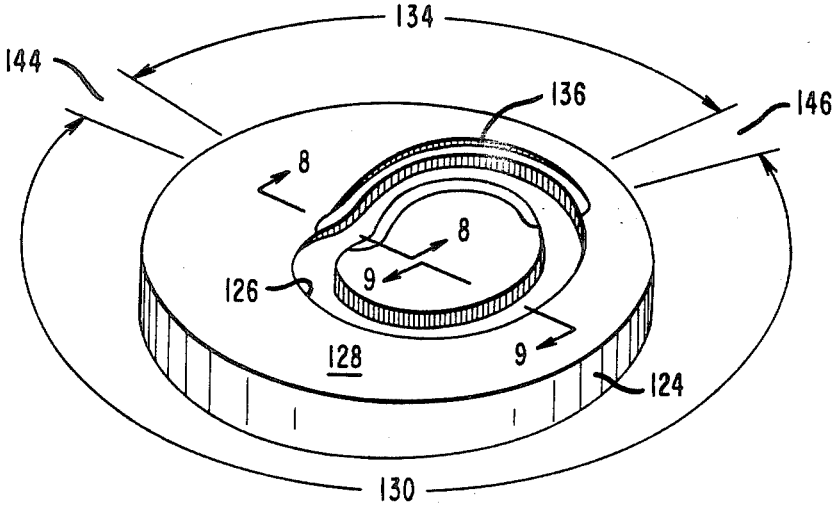
FIG. 7 is a further modification showing a plate cam having a varying thickness.
Figure 8:
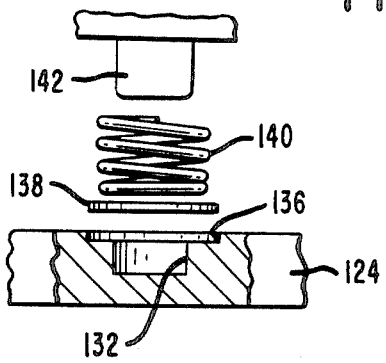
FIG. 8 is a view, partly in section, and taken along the line 8—8 of FIG. 7 and including cam follower means.
Figure 9:
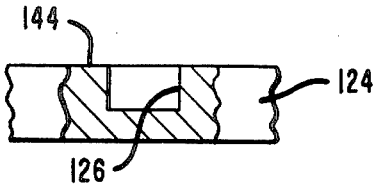
FIG. 9 is a view taken along the line 9—9 of FIG. 7.

FIG. 7 illustrates a modification of the plate cam arrangement wherein a plate cam 124 includes a groove 126 formed in an irregular path similar to that shown in FIG. 2 but having the same depth relative to the surface 128. The depth of groove 126 is shown in FIG. 9 and occupies that portion of the total groove path as indicated at 130 with arrows at the ends of such portion. A reduced depth portion 132 of the total groove path is indicated at 134 with arrows illustrating the extent of such reduced portion, and as shown in FIG. 8 with a recess 136 formed on either side of the groove 126. The recess accommodates a hardware washer 138 urged by a spring 140 fitting on a follower 142 riding in the groove 126.

In the FIG. 7 arrangement, the follower 142 rides in the groove 126 and the washer 138 rides on the surface 144 of the plate cam 124, as seen in FIG. 9, during the print portion of the printing cycle. During the return portion of the printing cycle the washer 138 rides in the recess 136 of the groove 132, it being seen that the depth of the groove 132 plus the depth of the recess 136 equals the depth of the groove 126. The recess 136 provides a ramp for turnaround of the print head at each end of the travel thereof, as indicated at 144 and 146 in FIG. 7.

Figure 10:
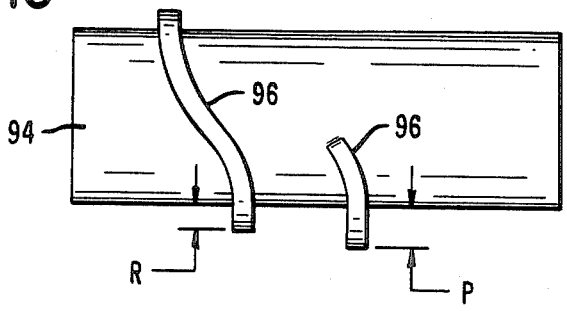
FIG. 10, on the sheet with FIG. 2, is an additional view of the drum cam arrangement.

FIG. 10 illustrates the drum cam 94 utilized for providing drive means for the print head carriage and such cam 94 includes the rail 96 which provides a surface for the ball 44. That portion of the rail 96 in operation during the print portion of the printing cycle is represented by the rail height P and that portion of the rail 96 in operation during the return portion of the printing cycle is represented by the height R. The rail height is changed to provide print head-platen pressure release or reduction during carriage return.

It is thus seen that herein shown and described is a thermal printer assembly that includes a pressure release mechanism having camming means operably associated with the print head carriage. The print head is maintained in printing condition with a predetermined pressure against the paper and the platen when the print head is moving in a first direction, and the pressure is released when the print head is moving in a second direction. The apparatus of the present invention enables the accomplishment of the objects and advantages mentioned above, and while a preferred embodiment and modifications have been disclosed herein, other variations may occur to those skilled in the art. It is contemplated that all such variations not departing from the spirit and scope of the invention hereof are to be construed in accordance with the following claims.

We claim:

1. A thermal printer comprising a platen, a print head adjacent the platen for printing on record media positioned between the print head and the platen, carriage means for supporting and for moving the print head in first and second directions across the printer, and means operably associated with the carriage means and including a cam mechanism comprising a plate-like cam member having a continuous irregular groove therein and a cam follower ball operating in the groove, said groove defining a portion of one depth for the cam follower ball in the first direction for printing operation and defining a portion of another depth for the cam follower ball in the second direction for return operation, said cam mechanism including a cylindrical member having a resilient member captured therein and means adjustably threaded into said cylindrical member for adjusting the force exerted by the resilient member on said cam follower ball, said adjustably threaded means and said resilient member biasing said cam follower ball into contact with said one and said another depth portions of said groove for holding the print head in printing condition with a predetermined pressure of the print head against the record media and the platen when the print head is moving in the first direction and for releasing the pressure of the print head relative to the record media and the platen when the print head is moving in the second direction.

2. The thermal printer of claim 1 wherein the carriage means is pivotally connected with the printer for permitting movement of the print head in a direction toward and away from the platen.

3. The thermal printer of claim 1 wherein the operably associated means includes print head drive means and means connecting the print head drive means and the carriage means for providing pivotal movement of the carriage means.

4. A mechanism for releasing pressure of a print head against a platen in a thermal printer comprising carriage means carrying the print head in transverse manner, and cam means operably associated with the carriage means and oomprising a plate-like cam member having a continuous irregular groove therein and a cam follower member operating in said groove, said groove defining a portion of one depth for the cam follower member in printing operation and defining a portion of another depth for the cam follower member in return operation, said groove having a recess along the portion defining said another depth and said cam means including a washing-like member riding on the surface of the cam member in printing operation and riding in the recess along the groove defining said another depth of the cam member in return operation, said cam means including a resilient member captured by said cam follower member and engageable with said washer-like member for maintaining the print head against the platen with a predetermined pressure when the print head is moving in a first direction and for reducing such predetermined pressure when the print head is moving in a second direction.

5. In a thermal printer having a platen and a print head operable therewith in printing operation for printing on record media positioned between the print head and the platen, and carriage means for moving the print head along the platen in one and a second direction, the improvement comprising means operably associated with the carriage means and including a cam mechanism comprising a plate-like cam member having a continuous groove therein and a cam follower member operating in the groove, said groove defining a portion of one depth for the cam follower member in printing operation and defining a portion of another depth for the cam follower member in return operation, said cam member including a cylindrical member having a spring captured therein and means adjustably threaded into said cylindrical member for adjusting the force exerted by said spring on said cam follower, said adjustably threaded means and said spring biasing said cam follower member into contact with said one and said another depth portions of said groove for holding the print head in printing condition with a predetermined pressure of the print head against the record media and the platen when the print head is moving in the one direction and for reducing the pressure of the print head relative to the record media and the platen when the print head is moving in the second direction.

6. In the thermal printer of claim 5 wherein the carriage means includes a shaft for pivotal connection of the carriage means with the printer and thereby allowing swinging movement of the print head in a direction toward and away from the platen.

* * * * *